US007695084B2

(12) United States Patent
Kawauchi

(10) Patent No.: US 7,695,084 B2
(45) Date of Patent: Apr. 13, 2010

(54) WAVEFORM DATA-PROCESSING DEVICE AND WAVEFORM DATA-PROCESSING METHOD

(75) Inventor: Kenichi Kawauchi, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1103 days.

(21) Appl. No.: 11/347,511

(22) Filed: Feb. 4, 2006

(65) Prior Publication Data

US 2007/0052743 A1 Mar. 8, 2007

(30) Foreign Application Priority Data

Sep. 5, 2005 (JP) ..... 2005-256744

(51) Int. Cl.
*B41J 29/38* (2006.01)

(52) U.S. Cl. ..... 347/10; 347/11; 347/5

(58) Field of Classification Search ..... 347/5, 347/9, 10, 11, 12, 14
See application file for complete search history.

(56) References Cited

U.S. PATENT DOCUMENTS 6,494,556 B1 * 12/2002 Sayama et al. ..... 347/11

6,619,777 B2 * 9/2003 Chang ..... 347/10

FOREIGN PATENT DOCUMENTS

JP 2003-237068 8/2003

* cited by examiner

*Primary Examiner*—Lam S Nguyen
(74) *Attorney, Agent, or Firm*—Fildes & Outland, P.C.

(57) ABSTRACT

The present invention provides a waveform data-processing device. This waveform data-processing device is equipped with a generation component and a sequencing component. The generation component, on the basis of each of a plurality of waveforms which are specified by respective durations and amplitudes, generates a plurality of waveform data sets. Each waveform data set is structured by partial waveform data representing, for each of nodes which are points in the waveform at which amplitude alters, a period until a next node in time and an amplitude change condition. The sequencing component sequences the partial waveform data of the respective nodes for each of the plurality of waveform data sets that have been generated by the generation component. In this waveform data-processing device, the sequencing component sequences partial waveform data of nodes with times which are the same between the waveform data sets to sequence positions which are the same.

10 Claims, 9 Drawing Sheets

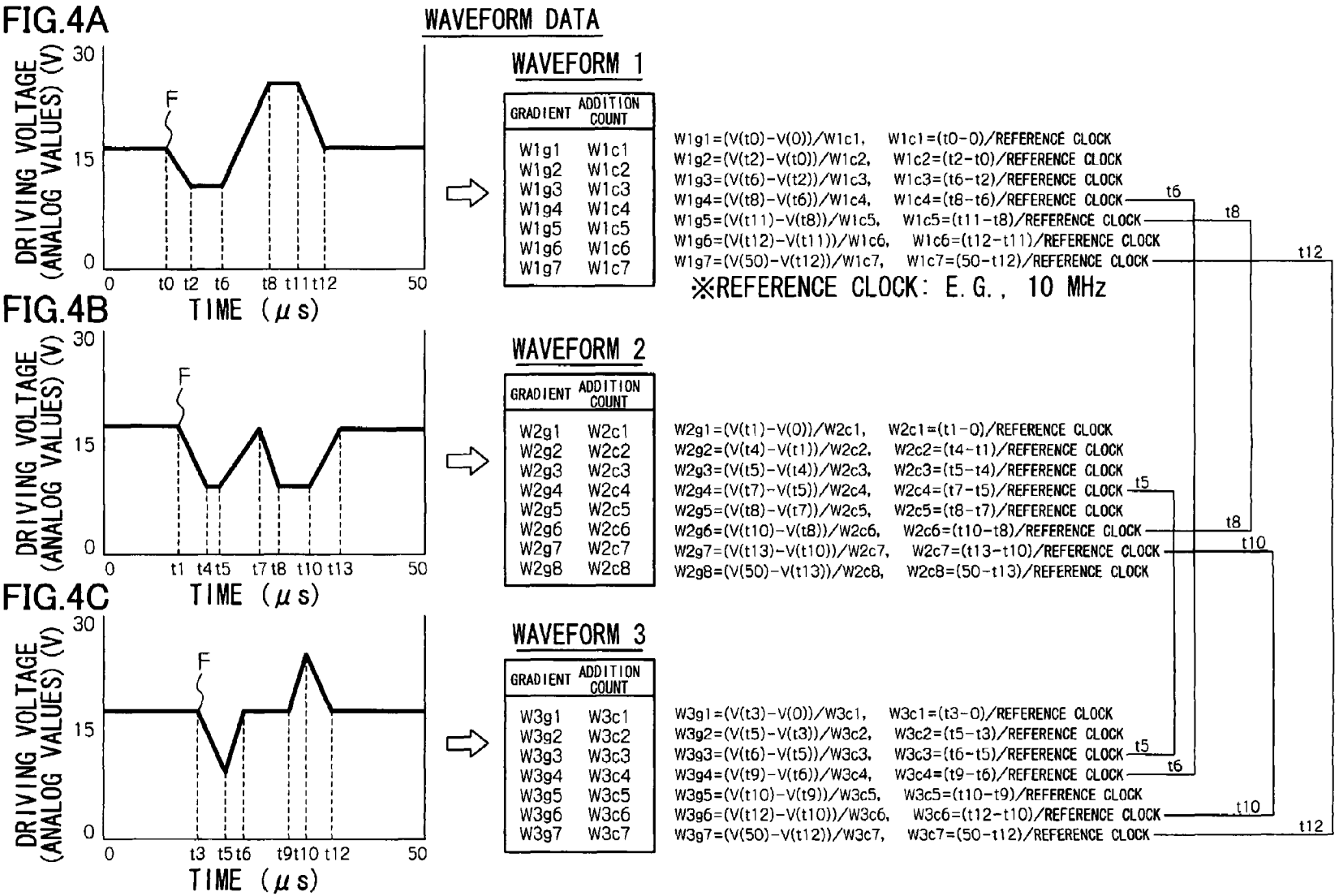
WAVEFORM DATA
FIG.4A
DRIVING VOLTAGE (ANALOG VALUES) (V)
30
15
0
F
t0 t2 t6 t8 t11 t12
50
TIME (μs)
WAVEFORM 1
GRADIENT
ADDITION COUNT
W1g1 W1c1
W1g2 W1c2
W1g3 W1c3
W1g4 W1c4
W1g5 W1c5
W1g6 W1c6
W1g7 W1c7
W1g1=(V(t0)-V(0))/W1c1, W1c1=(t0-0)/REFERENCE CLOCK
W1g2=(V(t2)-V(t0))/W1c2, W1c2=(t2-t0)/REFERENCE CLOCK
W1g3=(V(t6)-V(t2))/W1c3, W1c3=(t6-t2)/REFERENCE CLOCK
W1g4=(V(t8)-V(t6))/W1c4, W1c4=(t8-t6)/REFERENCE CLOCK
W1g5=(V(t11)-V(t8))/W1c5, W1c5=(t11-t8)/REFERENCE CLOCK
W1g6=(V(t12)-V(t11))/W1c6, W1c6=(t12-t11)/REFERENCE CLOCK
W1g7=(V(50)-V(t12))/W1c7, W1c7=(50-t12)/REFERENCE CLOCK
※REFERENCE CLOCK: E.G., 10 MHz
t6
t8
t12
FIG.4B
DRIVING VOLTAGE (ANALOG VALUES) (V)
30
15
0
F
t1 t4 t5 t7 t8 t10 t13
50
TIME (μs)
WAVEFORM 2
GRADIENT
ADDITION COUNT
W2g1 W2c1
W2g2 W2c2
W2g3 W2c3
W2g4 W2c4
W2g5 W2c5
W2g6 W2c6
W2g7 W2c7
W2g8 W2c8
W2g1=(V(t1)-V(0))/W2c1, W2c1=(t1-0)/REFERENCE CLOCK
W2g2=(V(t4)-V(t1))/W2c2, W2c2=(t4-t1)/REFERENCE CLOCK
W2g3=(V(t5)-V(t4))/W2c3, W2c3=(t5-t4)/REFERENCE CLOCK
W2g4=(V(t7)-V(t5))/W2c4, W2c4=(t7-t5)/REFERENCE CLOCK
W2g5=(V(t8)-V(t7))/W2c5, W2c5=(t8-t7)/REFERENCE CLOCK
W2g6=(V(t10)-V(t8))/W2c6, W2c6=(t10-t8)/REFERENCE CLOCK
W2g7=(V(t13)-V(t10))/W2c7, W2c7=(t13-t10)/REFERENCE CLOCK
W2g8=(V(50)-V(t13))/W2c8, W2c8=(50-t13)/REFERENCE CLOCK
t5
t8
t10
FIG.4C
DRIVING VOLTAGE (ANALOG VALUES) (V)
30
15
0
F
t3 t5 t6 t9 t10 t12
50
TIME (μs)
WAVEFORM 3
GRADIENT
ADDITION COUNT
W3g1 W3c1
W3g2 W3c2
W3g3 W3c3
W3g4 W3c4
W3g5 W3c5
W3g6 W3c6
W3g7 W3c7
W3g1=(V(t3)-V(0))/W3c1, W3c1=(t3-0)/REFERENCE CLOCK
W3g2=(V(t5)-V(t3))/W3c2, W3c2=(t5-t3)/REFERENCE CLOCK
W3g3=(V(t6)-V(t5))/W3c3, W3c3=(t6-t5)/REFERENCE CLOCK
W3g4=(V(t9)-V(t6))/W3c4, W3c4=(t9-t6)/REFERENCE CLOCK
W3g5=(V(t10)-V(t9))/W3c5, W3c5=(t10-t9)/REFERENCE CLOCK
W3g6=(V(t12)-V(t10))/W3c6, W3c6=(t12-t10)/REFERENCE CLOCK
W3g7=(V(50)-V(t12))/W3c7, W3c7=(50-t12)/REFERENCE CLOCK
t5
t6
t10
t12

FIG.6A

WAVEFORM DATA (BEFORE CONVERSION)

| ADDRESS | WAVEFORM 1 GRADIENT | WAVEFORM 1 ADDITION COUNT | WAVEFORM 2 GRADIENT | WAVEFORM 2 ADDITION COUNT | WAVEFORM 3 GRADIENT | WAVEFORM 3 ADDITION COUNT |
|---|---|---|---|---|---|---|
| 0 | W1g1 | W1c1 | W2g1 | W2c1 | W3g1 | W3c1 |
| 1 | W1g2 | W1c2 | W2g2 | W2c2 | W3g2 | W3c2 |
| 2 | W1g3 | W1c3 | W2g3 | W2c3 | W3g3 | W3c3(t5) |
| 3 | W1g4 | W1c4 | W2g4 | W2c4(t5) | W3g4 | W3c4 |
| 4 | W1g5 | W1c5 | W2g5 | W2c5 | W3g5 | W3c5 |
| 5 | W1g6 | W1c6 | W2g6 | W2c6 | W3g6 | W3c6 |
| 6 | W1g7 | W1c7 | W2g7 | W2c7 | W3g7 | W3c7 |
| 7 | VACANT | | W2g8 | W2c8 | VACANT | |

FIG.6B

WAVE FORM DATA (AFTER CONVERSION)

| ADDRESS | WAVEFORM 1 GRADIENT | WAVEFORM 1 ADDITION COUNT | WAVEFORM 2 GRADIENT | WAVEFORM 2 ADDITION COUNT | WAVEFORM 3 GRADIENT | WAVEFORM 3 ADDITION COUNT |
|---|---|---|---|---|---|---|
| 0 | W1g1 | W1c1 | W2g1 | W2c1 | W3g1 | W3c1 |
| 1 | W1g2 | W1c2 | W2g2 | W2c2 | W3g2 | W3c2 |
| 2 | W1g3 | W1c3 | W2g3 | W2c3 | VACANT | |
| 3 | VACANT | | W2g4 | W2c4(t5) | W3g3 | W3c3(t5) |
| 4 | W1g4 | W1c4 | W2g5 | W2c5 | W3g4 | W3c4 |
| 5 | W1g5 | W1c5 | W2g6 | W2c6 | W3g5 | W3c5 |
| 6 | W1g6 | W1c6 | W2g7 | W2c7 | W3g6 | W3c6 |
| 7 | W1g7 | W1c7 | W2g8 | W2c8 | W3g7 | W3c7 |

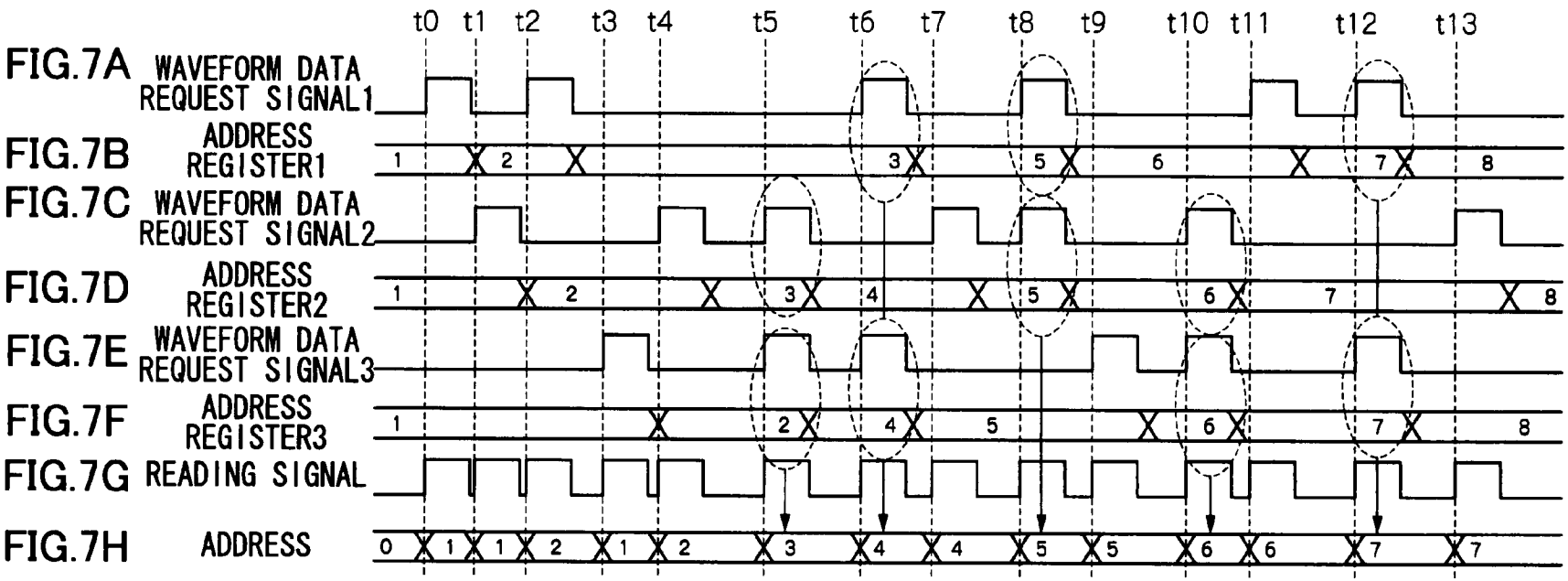
t0
t1
t2
t3
t4
t5
t6
t7
t8
t9
t10
t11
t12
t13
FIG.7A WAVEFORM DATA REQUEST SIGNAL1
FIG.7B ADDRESS REGISTER1
FIG.7C WAVEFORM DATA REQUEST SIGNAL2
FIG.7D ADDRESS REGISTER2
FIG.7E WAVEFORM DATA REQUEST SIGNAL3
FIG.7F ADDRESS REGISTER3
FIG.7G READING SIGNAL
FIG.7H ADDRESS

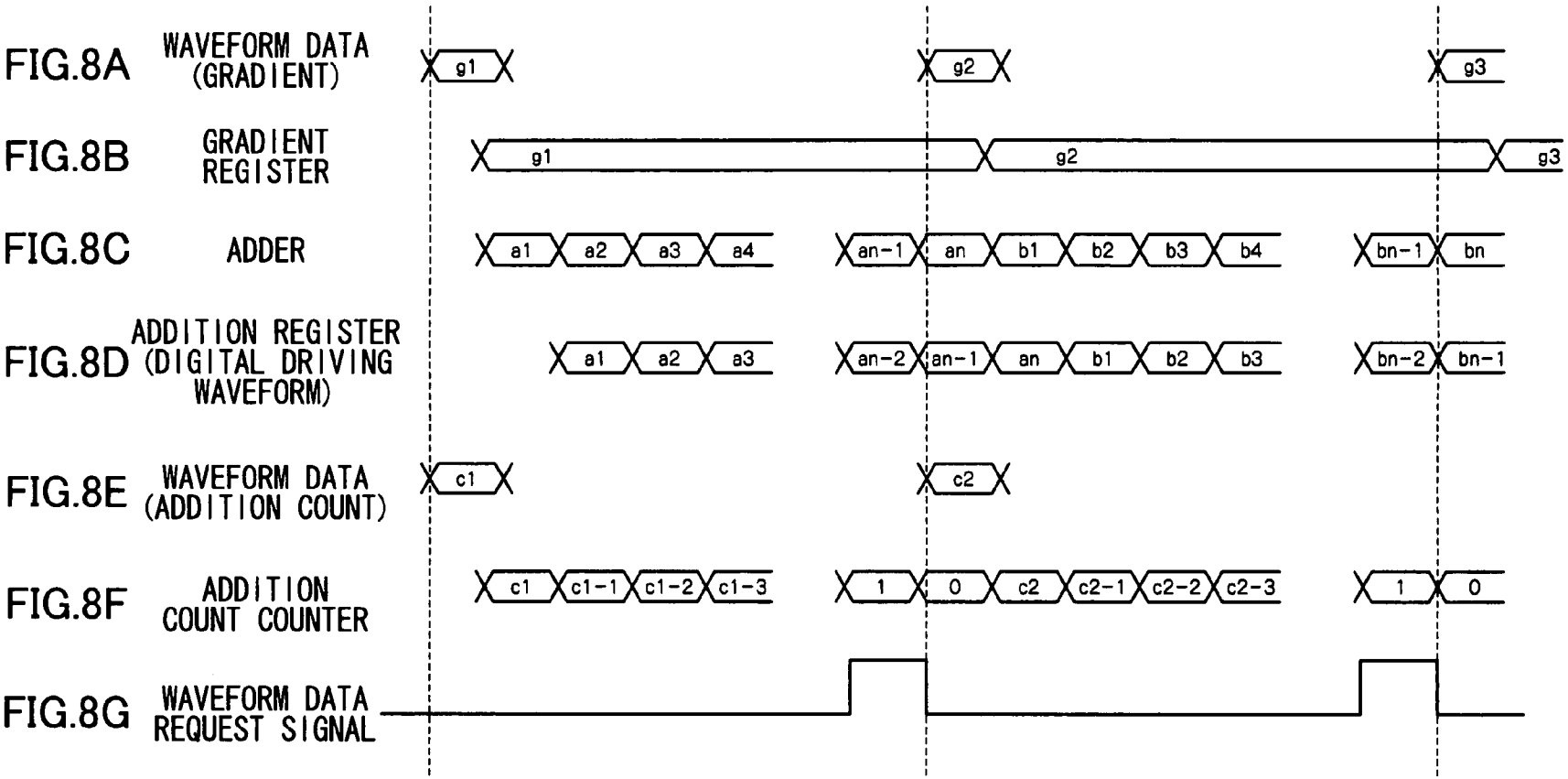
FIG.8A WAVEFORM DATA (GRADIENT)
FIG.8B GRADIENT REGISTER
FIG.8C ADDER
FIG.8D ADDITION REGISTER (DIGITAL DRIVING WAVEFORM)
FIG.8E WAVEFORM DATA (ADDITION COUNT)
FIG.8F ADDITION COUNT COUNTER
FIG.8G WAVEFORM DATA REQUEST SIGNAL
g1
g2
g3
a1
a2
a3
a4
an-1
an
b1
b2
b3
b4
bn-1
bn
an-2
an-1
an
b1
b2
b3
bn-2
bn-1
c1
c1
c1-1
c1-2
c1-3
1
0
c2
c2
c2-1
c2-2
c2-3
1
0

WAVEFORM DATA-PROCESSING DEVICE AND WAVEFORM DATA-PROCESSING METHOD

CROSS-REFERENCE TO RELATED APPLICATION

This application claims priority under 35 USC 119 from Japanese Patent Application No. 2005-256744, the disclosure of which is incorporated by reference herein.

BACKGROUND OF THE INVENTION

1. Field of the Invention

The present invention relates to a waveform data-processing program, a waveform data-processing method, a waveform data-processing device and a droplet ejection device, and more specifically relates to a waveform data-processing program, waveform data-processing method, waveform data-processing device and droplet ejection device in which: a plurality of waveform data sets are generated, each of which is structured by partial waveform data sets representing, for each of nodes which are points in a waveform at which amplitude alters, a period until a next node and an amplitude change condition; and, for each of the plurality of waveform data sets that have been generated, the partial waveform data sets of the respective points are sequenced.

2. Description of the Related Art

Heretofore, an inkjet head has been proposed which includes a pressure generation chamber charged with ink and a piezoelectric actuator. A driving waveform which is structured by a collection of trapezoid waves and/or triangular waves is applied to the piezoelectric actuator of the inkjet head, causing an ink droplet to be ejected by altering volume of the piezoelectric actuator and pressure of the pressure generation chamber.

Further, as a driving waveform generation device for such an inkjet head, a device has been proposed (see Japanese Patent Application Laid-Open (JP-A) No. 2003-237068) which generates a digital driving waveform of digital signals from waveform information which has been read from a storage component, modulates the generated digital driving waveform, demodulates output of the modulation to generate an analog waveform corresponding to an actual driving waveform and, on the basis of output of the demodulation, supplies voltages and currents which are capable of driving the inkjet head. In the device disclosed in JP-A No. 2003-237068, a single digital driving waveform is processed. If this is extended to a plurality of waveforms, then there are simultaneous accesses to the storage component, and delays arise in reading of the digital driving waveforms from the storage component. As a result, delays occur in waveform generation.

SUMMARY OF THE INVENTION

The present invention has been made in view of the above circumstances, and provides a waveform data-processing method and a waveform data-processing device.

A first aspect of the present invention is a storage medium readable by a computer, the storage medium storing a program of instructions executable by the computer to perform a function for processing waveform data, the function including the steps of: (a) with a generation component, on the basis of each of a plurality of waveforms which are respectively specified by durations and amplitudes, generating a plurality of waveform data sets, each of which is structured by partial waveform data sets representing, for each of nodes which are points in the waveform at which amplitude alters, a period until a next node in time and an amplitude change condition; and (b) with a sequencing component, sequencing the partial waveform data sets of the respective nodes for each of the plurality of waveform data sets that have been generated by the generation component, wherein, in step (b), partial waveform data sets of nodes with matching times in respective waveform data sets are sequenced to matching sequence positions.

A second aspect of the present invention is a waveform data-processing method including: (a) with a generation component, on the basis of each of a plurality of waveforms which are respectively specified by durations and amplitudes, generating a plurality of waveform data sets, each of which is structured by partial waveform data sets representing, for each of nodes which are points in the waveform at which amplitude alters, a period until a next node in time and an amplitude change condition; and (b) with a sequencing component, sequencing the partial waveform data sets of the respective nodes for each of the plurality of waveform data sets that have been generated by the generation component, wherein, in (b), partial waveform data sets of nodes with matching times in respective waveform data sets are sequenced to matching sequence positions.

A third aspect of the present invention is a waveform data-processing device including: a generation component which, on the basis of each of a plurality of waveforms which are respectively specified by durations and amplitudes, generates a plurality of waveform data sets, each of which is structured by partial waveform data sets representing, for each of nodes which are points in the waveform at which amplitude alters, a period until a next node in time and an amplitude change condition; and a sequencing component which sequences the partial waveform data sets of the respective nodes for each of the plurality of waveform data sets that have been generated by the generation component, wherein the sequencing component sequences partial waveform data sets of nodes with matching times in respective waveform data sets to matching sequence positions.

A fourth aspect of the present invention is a droplet ejection device including: a generation component which, on the basis of each of a plurality of waveforms which are respectively specified by durations and amplitudes, generates a plurality of waveform data sets, each of which is structured by partial waveform data sets representing, for each of nodes which are points in the waveform at which amplitude alters, a period until a next node in time and an amplitude change condition; a sequencing component which sequences the partial waveform data sets of the respective nodes for each of the plurality of waveform data sets that have been generated by the generation component, and sequences partial waveform data sets of nodes with matching times in respective waveform data sets to matching sequence positions; a memory component which memorizes the respective partial waveform data sets of the respective waveform data sets to memory regions that correspond to sequence positions of the partial waveform data sets; a reading component which reads the partial waveform data sets of the respective waveform data sets, which have been memorized at the memory regions, in one batch for each memory region; a waveform generation component which generates a waveform on the basis of the partial waveform data sets of each waveform data set which are read by the reading component; and droplet ejection components which eject droplets in accordance with the waveforms generated by the waveform generation component.

BRIEF DESCRIPTION OF THE DRAWINGS

An embodiment of the present invention will be described in detail based on the following figures, wherein:

FIGS. 4A to 4C are explanatory charts for explaining details of generation of digital waveform data from analog driving waveforms;

FIGS. 6A and 6B are explanatory charts for explaining sequencing of partial waveform data in the waveform data-processing program.

FIGS. 7A to 7H are timing charts of elements in the control component 20;

FIGS. 8A to 8G are timing charts of elements in the digital calculation component 30.

DETAILED DESCRIPTION OF THE INVENTION

Herebelow, an embodiment of the present invention will be described in detail with reference to the drawings.

Figure 9:
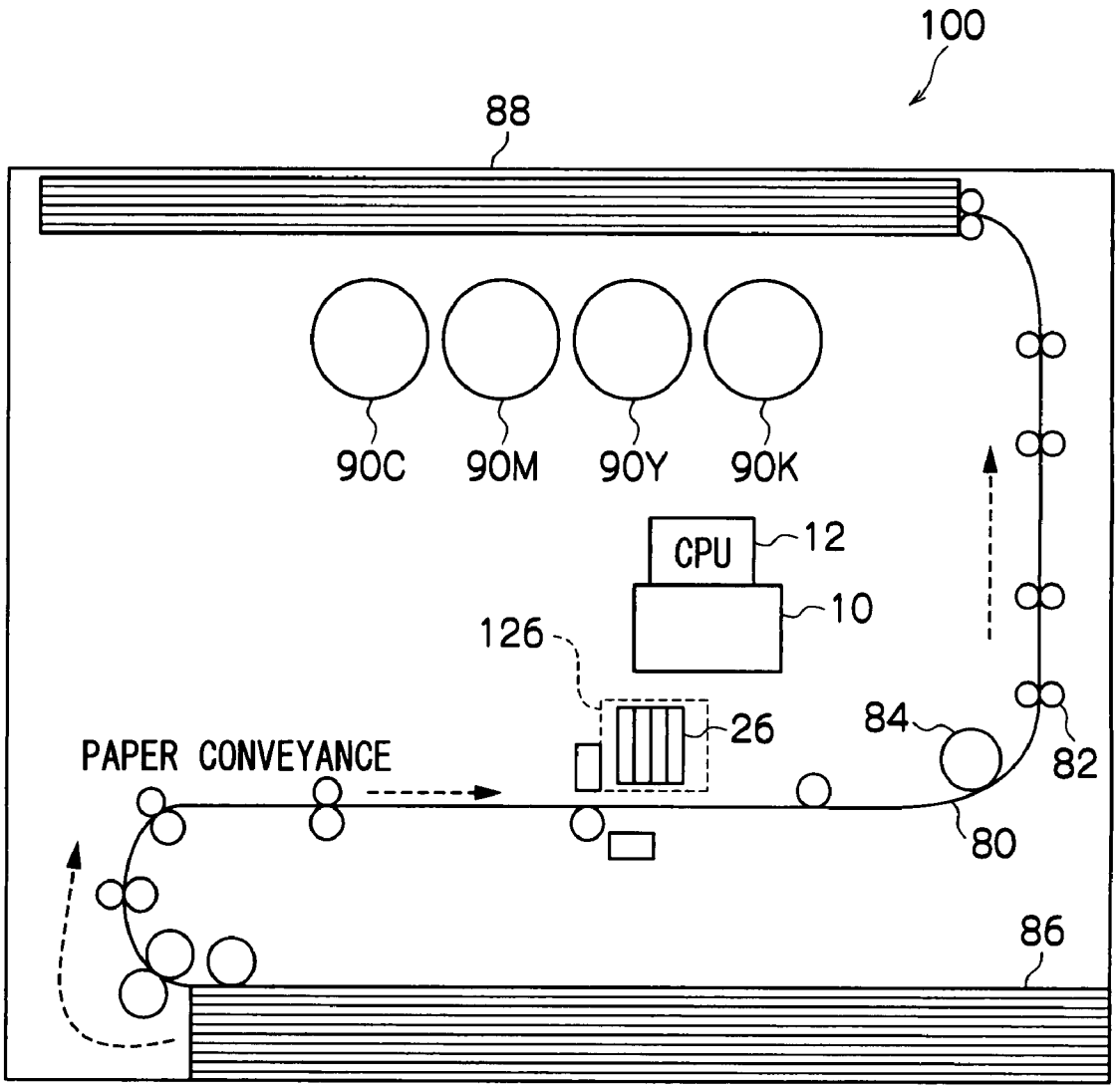
FIG. 9 is an interior structural view of a droplet ejection device 100.

As shown in FIG. 9, a driving waveform generation device 10, which serves as a waveform data-processing device of the present embodiment, is provided at a droplet ejection device 100.

A transport path 80 is provided in the droplet ejection device 100, for transporting paper which has been stored at a paper tray 86 to an ejection tray 88. The transport path 80 is formed by a plurality of roller pairs 82 and a driving roller 84, supplies the paper one sheet at a time from the paper tray 86 and finally feeds the paper out to the ejection tray 88.

Partway along the transport path 80, a recording head array 126 is arranged along a conveyance direction of the paper. The recording head array 126 is connected to the driving waveform generation device 10 and is structured by a plurality of recording heads 26, for each of the colors cyan (C), magenta (M), yellow (Y) and black (K). The recording head array 126 is controlled as will be described later to eject ink for forming images on the paper. Here, a system such as a thermal system, a piezoelectric system or the like can be employed for the recording heads.

Ink tanks 90C, 90M, 90Y and 90K, which store ink of the respective colors, are connected, via piping, with the recording heads 26 of the respective colors, and supply the inks of the respective colors to the recording heads 26. Here, various known inks may be employed as the inks: for example, water-based inks, oil-based inks, solvent type inks and so forth.

Figure 1:
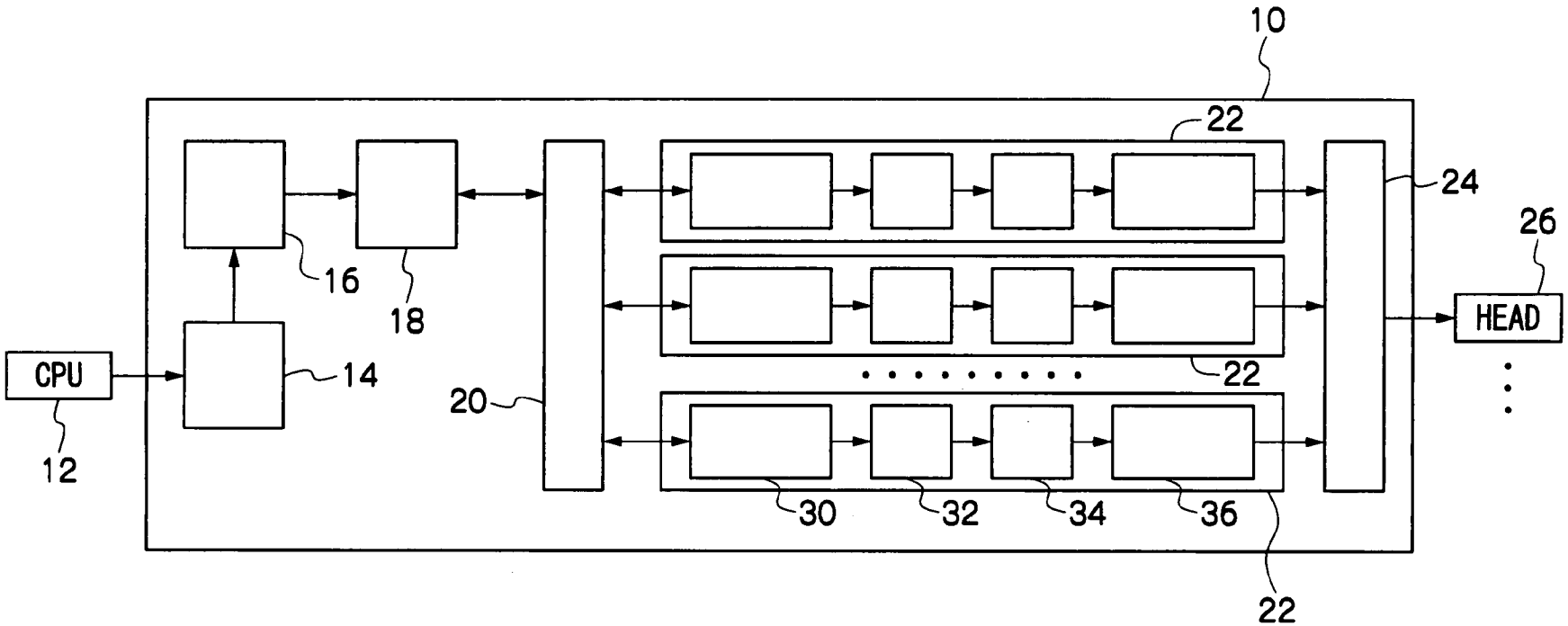
FIG. 1 is a block diagram of a driving waveform generation device.

The driving waveform generation device 10 is equipped with a CPU 12, a waveform generation component 14, a waveform arrangement component 16 and a waveform storage component 18 (see FIG. 1). The CPU 12 controls the device as a whole, the waveform generation component 14 generates waveform data based on driving waveforms, the waveform arrangement component 16 arranges and converts waveform data which has been sent thereto from the waveform generation component 14, and the waveform storage component 18 stores waveform data which has been arranged and converted by the waveform arrangement component 16.

The driving waveform generation device 10 is also equipped with a plurality of waveform generation components 22 with respectively similar structures, and the control component 20. The control component 20 receives waveform data request signals from the waveform generation components 22, and reads waveform data from the waveform storage component 18.

Each waveform generation component 22 is equipped with the digital calculation component 30, a modulation component 32, a demodulation component 34 and a power amplification component 36. The digital calculation component 30 generates a digital driving waveform by incrementally accumulating waveform data, the modulation component 32 generates a modulated signal from the digital driving waveform, the demodulation component 34 demodulates the modulated signal and generates an analog driving waveform, and the power amplification component 36 amplifies the analog driving waveform to a power required for head driving. Herein, the modulation component 32 and demodulation component 34 may be formed as a D/A conversion component.

The waveform generation components 22 are further connected to a waveform selection component 24. The waveform selection component 24 selects a desired driving waveform from the respective driving waveforms generated by the waveform generation components 22, and outputs that driving waveform to one of the recording heads 26, which is a droplet ejection component for ejecting ink.

The present embodiment may employ a plurality of the waveform generation components 22. However, for ease of explanation, a case in which only three of the waveform generation components 22 are provided will now be described.

Figure 2:
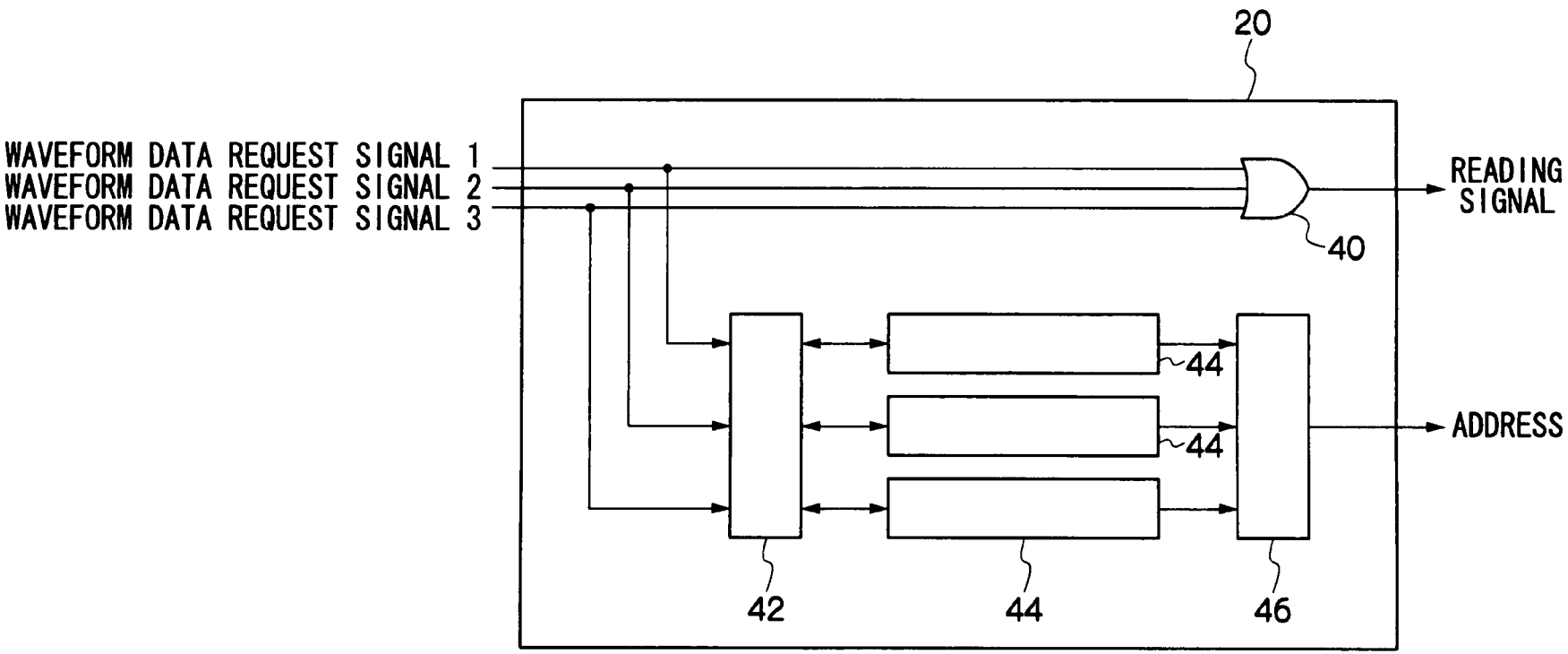
FIG. 2 is a block diagram of a control component 20.

As shown in FIG. 2, the control component 20 is equipped with an OR circuit 40, an address control portion 42, three address registers 44, and an address selection portion 46. The OR circuit 40 is inputted with waveform data request signals 1 to 3, from the three waveform generation components 22, and outputs a reading signal. The address control portion 42 generates addresses in accordance with the waveform data request signals from the three waveform generation components 22, the address registers 44 store the generated addresses, and the address selection portion 46 selects an address to be outputted from the three address registers 44 to the waveform storage component 18.

Here, the address control portion 42 basically increments values of the address registers 44 in accordance with the waveform data request signals. However, when waveform data request signals are simultaneously inputted, the address control portion 42 increments the one of the corresponding address registers that has the largest value and stores the incremented value in that address register 44.

The address selection portion 46 basically selects the value of the address register 44 for which a waveform data request signal has been inputted. However, when waveform data request signals are simultaneously inputted, the address selection portion 46 selects the one of the corresponding address registers that has the largest value.

Figure 3:
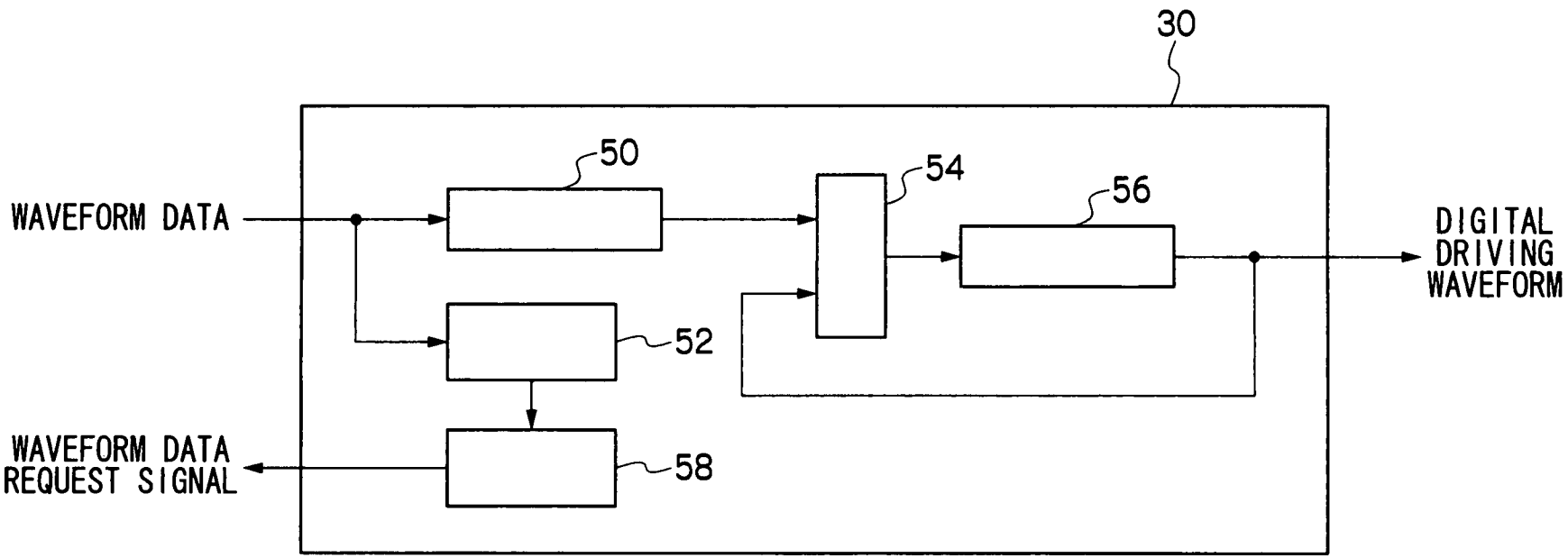
FIG. 3 is a block diagram of a digital calculation component 30.

As shown in FIG. 3, the digital calculation component 30 is equipped with a gradient register 50, an addition count counter 52, an adder 54, an addition register 56 and a waveform data request portion 58. The gradient register 50 stores gradient data from the waveform data, which will be described in more detail later. The addition count counter 52 counts down an addition count value from the waveform data, which will be described in more detail later. The adder 54 adds the gradient register value to the addition register value, to increment the addition register value by the gradient register value in proportion to the addition count value. The addition register 56 stores values generated by the adder 54 and outputs the same to the modulation component 32 as a digital driving waveform. The waveform data request portion 58 generates a waveform data request signal from a count value of the addition count counter 52.

Next, operations of the present embodiment will be described.

First, as shown in FIGS. 4A to 4C, the waveform generation component 14 generates the waveform data. That is, on the basis of a plurality (three in the present embodiment) of analog waveforms specified by respective durations and amplitudes, the waveform generation component 14 generates three waveform data sets (see waveform 1, waveform 2 and waveform 3). Each of the waveform data sets is structured by partial waveform data sets, which represent, for each of nodes F which are points in the waveform at which amplitude alters, an amplitude change condition and a duration until a next node. That is, the three waveform data sets are respectively structured by, for example, addition counts and gradients.

For example, as shown in FIG. 4A, in the analog waveform, addition counts and gradients are generated for each of nodes F at times t0, t2, t6, t8, t11 and t12.

For example, for the node at time t0, an addition count W1*c*2, which represents a period until the next node in time (at time t2), is calculated by:

$$\text{Addition count } W1c2=(t2-t0)/\text{reference clock}$$

Here, the reference clock is, for example, 10 MHz.

A gradient W1*g*2, which represents an amplitude change condition until the next node in time (at time t2), is calculated by:

$$\text{Gradient } W1g2=(V(t2)-V(t0))/W1c2$$

Similar calculations are performed for the other nodes. Further, the above calculations are performed for each of the analog waveforms.

Figure 5:
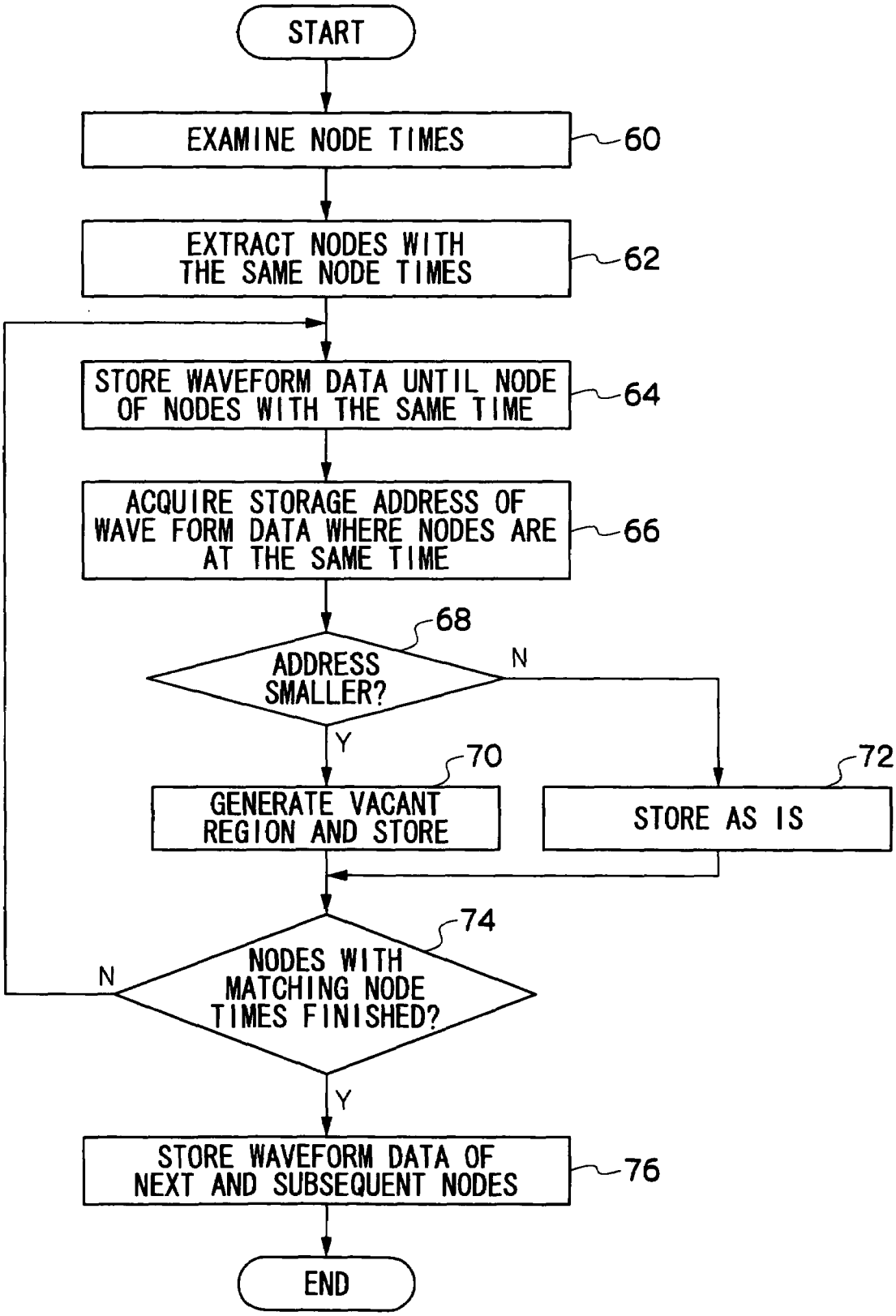
FIG. 5 is a flowchart showing a waveform data-processing program which is executed by a waveform arrangement component.

When the three waveform data sets respectively structured by partial waveform data sets (addition counts and gradients) for the respective nodes have been generated as described above, the waveform data sets are outputted from the waveform generation component 14 to the waveform arrangement component 16 together with times of the nodes. When the waveform data is inputted, the waveform arrangement component 16 starts the waveform data-processing program shown in FIG. 5.

In step 60, the times of the nodes (t0 to t13) are examined and, in step 62, nodes for which the times are the same are extracted.

As shown in FIGS. 4A to 4C, each analog waveform may include nodes whose times match others of the analog waveforms. Accordingly, the waveform data may include partial waveform data sets with matching nodes as structural elements.

For example, waveform 1 (see FIG. 4A) has nodes at the times t6, t8 and t12, waveform 2 (see FIG. 4B) has nodes at the times t5, t8 and t10, and waveform 3 (see FIG. 4C) has nodes at the times t5, t6, t10 and t12. In step 62, accordingly, the times of nodes with the same times are extracted (i.e., t5, t6, t8, t10 and t12).

In step 64, the waveform data (partial waveform data) until the node at which the nodes match in time is stored. As mentioned above, the time of the first nodes with the same time is t5. Thus, in step 64, the partial waveform data until time t5 is sequenced as shown in FIG. 6A and is stored at the waveform storage component 18.

That is, for example, the nodes of waveform 1 until time t5 are, as shown in FIG. 4A, a node at time t2. Thus, in step 64, the partial waveform data until the node at time t2 ((W1*g*1, W1*c*1), (W1*g*2,W1*c*2) and (W1*g*3,W1*c*3)) is sequenced in node order and is stored at the waveform storage component 18.

Further, the nodes of waveform 2 until time t5 are, as shown in FIG. 4B, a node at time t5. Thus, in step 64, the partial waveform data until the node at time t5 ((W2*g*1,W2*c*1), (W2*g*2,W2*c*2), (W2*g*3,W2*c*3) and (W2*g*4,W2*c*4)) is sequenced in node order and is stored at the waveform storage component 18.

Further, the nodes of waveform 3 until the time t5 are, as shown in FIG. 4C, a node at time t5. Thus, in step 64, the partial waveform data until the node at time t5 ((W3*g*1, W3*c*1), (W3*g*2,W3*c*2) and (W3*g*3,W3*c*3)) is sequenced in node order and is stored at the waveform storage component 18.

If the data is stored as described above, then, as shown in FIG. 6A, the partial waveform data sets of the nodes at time t5 will be sequenced to a fourth sequence position (address '3') for waveform 2 but to a third position (address '2') for waveform 3. In this situation, in order to read the partial waveform data for time t5, the partial waveform data sets of the three waveforms 1 to 3 that are memorized at address '2' would be read in one batch, and then the partial waveform data sets of the three waveforms 1 to 3 that are memorized at address '3' would be read in one batch. Therefore, reading of the partial waveform data would be slow and, as a result, formation of the final waveforms would be delayed.

Accordingly, in the present embodiment, each waveform data set is sequenced such that partial waveform data sets of nodes whose times match are at matching sequence positions. More specifically, the two waveforms 2 and 3, partial waveform data sets of which are to be sequenced to the same position, include different numbers of nodes prior to the same-time nodes at time t5. In this case, waveform 3 is the waveform that includes a smaller number of nodes prior to the node of time t5. When the partial waveform data of the nodes of waveform 3 prior to the node at time t5 is being sequenced, a blank position is provided, as shown in FIG. 6B, at which there is no partial waveform data.

In the program for executing the above, in step 66, storage addresses of the waveform data for cases of nodes whose times are the same are acquired. In the example described above, as shown in FIG. 6A, the storage address of the partial waveform data set of the node at time t5 in waveform 2 is '3' and the storage address of the partial waveform data set of the node at time t5 in waveform 3 is '2', and these are acquired.

In a next step 68, it is judged whether or not one address is smaller. That is, when the present program is being applied to waveform 3, the judgment of step 68 is positive and, in step 70, as shown in FIG. 6B, a vacant region is provided with the partial waveform data set for time t5 being stored at a subsequent address (position) in the waveform storage component 18. On the other hand, when the present program is applied to waveform 2, the judgment of step 68 is negative and, in step 72, the partial waveform data is stored at the waveform storage component 18 without alteration. Accordingly, as shown in FIG. 6B, the partial waveform data set is stored without alteration at the above-mentioned acquired address (3).

By the processing described above, the partial waveform data sets for time t5 are sequenced to the same position (address '3') and stored to the waveform storage component 18. In other words, the partial waveform data set of waveform 3 is sequenced so as to correspond with the position of the partial waveform data set of waveform 2.

Then, step 74 judges whether or not the nodes with matching times have all been processed. If not all the nodes have been finished, the procedure returns to step 64 and performs the processing described above (steps 64 to 74). When all the nodes whose times are the same have been finished, waveform data (partial waveform data) from the next node onward is stored by step 76, and the present program finishes.

When, as described above, the partial waveform data sets of the nodes with matching times have been sequenced to the matching positions and memorized at memory regions with matching addresses in the waveform storage component 18, in accordance with instructions from the waveform generation components 22 for reading the waveform data, the control component 20 reads the partial waveform data from the memory regions at the respective addresses.

FIG. 1 is illustrated with three of the waveform generation components 22 represented. The control component 20 is instructed such that, for example, the upper waveform generation component 22 reads waveform 1, the middle waveform generation component 22 reads waveform 2 and the lower waveform generation component 22 reads waveform 3.

The digital calculation components 30 of the waveform generation components 22 output waveform data request signals to the control component 20. Here, in order to instruct reading of waveform 1, the upper waveform generation component 22 outputs a waveform data request signal 1 to the control component 20, in order to instruct reading of waveform 2, the middle waveform generation component 22 outputs a waveform data request signal 2 to the control component 20, and in order to instruct reading of waveform 3, the lower waveform generation component 22 outputs a waveform data request signal 3 to the control component 20.

At the control component 20 to which the waveform data request signal 1, 2 or 3 is inputted, the waveform data request signal 1, 2 or 3 is inputted to the OR circuit 40, a reading signal is outputted to the waveform storage component 18, and the waveform data request signal 1, 2 or 3 is inputted to the address control portion 42.

The address control portion 42 generates an address from the waveform data request signal 1, 2 or 3 and stores the address in the address register 44. Initially, '0' is stored in each address register 44, and the address selection portion 46 instructs the waveform storage component 18 to read out the partial waveform data sets of address '0'. Thereafter, the address control portion 42 stores '1' in each address register 44.

The waveform storage component 18 which has been instructed to read out the partial waveform data sets of address '0' as described above reads out, of the respective waveform data sets, the partial waveform data sets memorized at the memory region for address '0', as shown in FIG. 6B (W1*g*1, W1*c*1), (W2*g*1,W2*c*1) and (W3*g*1,W3*c*1), and outputs this partial waveform data to the digital calculation component 30 via the control component 20.

Subsequently, when the time to is reached, because waveform 1 includes a node at time t0, the digital calculation component 30 of the upper waveform generation component 22 outputs the waveform data request signal 1 to the control component 20.

The address control portion 42 causes address '1' to be outputted from the address register 44 that corresponds to the waveform data request signal 1 to the address selection portion 46 (see FIG. 7B), and sets the value of the address register 44 corresponding to the waveform data request signal 1 from '1' to '2' (see FIG. 7B again). The value of address '1' is outputted from the address register 44 to the address selection portion 46 (see FIG. 7H). Hence, the waveform storage component 18 is instructed to read out the partial waveform data sets of address '1'.

The waveform storage component 18 reads out the partial waveform data of address '1' of each waveform data set as one batch, and outputs the same to the waveform generation components 22 via the control component 20.

Because it is the upper waveform generation component 22 that outputted the waveform data request signal, on this occasion, of the partial waveform data sets for address '1' of each waveform data set that have been read from the waveform storage component 18 and outputted in one batch, only the partial waveform data corresponding to waveform 1 is accepted, by the upper waveform generation component 22. As shown in FIG. 3, of this partial waveform data set, the gradient is inputted to the gradient register 50 and the addition count is inputted to the addition count counter 52.

When the gradient has been inputted to the gradient register 50, this value is retained as shown in FIG. 8B and, as shown in FIG. 8C, the adder 54 adds the value of the gradient register 50 to the value of the addition register 56 until subsequent gradient data is inputted (see FIG. 8A). Thus, the value of the gradient register 50 is proportionally accumulated with the value of the addition register 56, and this is inputted to the modulation component 32. The demodulation component 34 demodulates the modulated signal to generate an analog driving waveform. The power amplification component 36 amplifies the analog driving waveform to a power required for head driving, and feeds this to the recording head 26 via the waveform selection component 24.

The above-described processing is applied to each of the waveform generation components 22. For example, when time t3 is reached, because waveform 3 features a node at time t3, the lower waveform generation component 22 outputs the waveform data request signal 3 to the control component 20 (see FIG. 7E). At this time, because a '1' is stored at the lower address register 44, the address selection portion 46 outputs the address '1' to the waveform storage component 18 (see FIG. 7H). As a result, the partial waveform data sets memorized at the memory regions of address '1' are read out from the waveform storage component 18 and outputted to the waveform generation components 22. After this processing, a '2' is stored at the lower address register 44.

Then, when time t5 is reached, the waveform data request signals 2 and 3 are outputted from the middle and lower waveform generation components 22 to the control component 20.

The waveform data request signals 2 and 3 are inputted to the address control portion 42. At this time, although a value of address '3' is memorized at the middle address register 44 as shown in FIG. 7D, a value of address '2' is memorized at the lower address register 44 as shown in FIG. 7F. If these were to be outputted to the waveform storage component 18 as they are, the partial waveform data set of each waveform data set that has been memorized at the memory region of address '2' would be read, and additionally the memory region of address '3' of each waveform data set would be read. Thus, reading of the waveform data would take time, with an adverse effect on waveform generation.

Accordingly, in the present embodiment, as shown in FIG. 7H, of these two address registers 44, the address with the largest value ('3') is outputted as the address. Hence, the waveform storage component 18 reads out the partial waveform data sets memorized at the memory regions of address '3', and outputs the same to the waveform generation components 22 via the control component 20.

At this time, as shown in FIG. 6B, the partial waveform data sets of the waveforms 2 and 3 for the nodes at time t5 are memorized at the same sequence position, with address '3'. Thus, the required partial waveform data sets can be read out and outputted to the waveform generation components 22 at time t5. Subsequent processing is similar.

The present embodiment as described above sequences partial waveform data sets for nodes at matching times to matching positions. Hence, the respective partial waveform data sets of each waveform data set are memorized at memory regions, of the waveform storage component 18, of addresses corresponding to those positions. When the partial waveform data memorized at the memory regions is being read out, it is possible to read each address as a single batch and, even when simultaneous accesses to the waveform storage component 18 occur, it is possible to suppress delays in reading of the waveform data from the waveform storage component 18.

Herein, the waveform generation component may be structured to alter the waveform data in accordance with temperature.

For the embodiment described above, an example of a case in which ink is employed as droplets has been described. However, the present invention is not limited thus. Instead of ink, for example, a reaction fluid could be employed. More specifically, when there is an effect of density varying in accordance with application amounts of a reaction fluid, and variations in density of the reaction fluid are to be controlled, the present invention can be applied in the same manner as described above. Further, with the inkjet process, the present invention can be applied in the same manner as described above to application of an orientation film formation material for liquid crystal elements, application of flux, application of adhesive, and so forth.

Thus, on the basis of each of a plurality of waveforms which are specified by respective durations and amplitudes, the present invention generates a plurality of waveform data sets, each of which is structured by partial waveform data sets representing, for each of nodes which are points in the waveform at which amplitude alters, a period until a next node in time and an amplitude change condition. For each of the plurality of waveform data sets which have been generated, when the partial waveform data sets of the respective nodes are being sequenced, the present invention sequences such that partial waveform data sets of nodes of the respective waveform data sets whose times are the same are sequenced to matching positions.

Herein, in a step of sequencing, if numbers of nodes prior to the nodes with the matching times differ between the two or more waveform data sets in which the partial waveform data sets are to be sequenced to the matching positions, then when, of the waveform data set that includes a smaller number of nodes prior to the node with the matching time, the partial waveform data set of a node prior to the node with the matching time is being sequenced, a blank position at which there is no partial waveform data may be provided.

Thus, when partial waveform data sets whose nodes are at the same time are sequenced to the same position, the partial waveform data sets of the respective waveform data sets are memorized at memory regions of a memory medium corresponding to that position. When the partial waveform data memorized at the memory regions is to be read out, the partial waveform data can be read from each memory region in one batch. Thus, even when simultaneous accesses to the memory component occur, a delay in reading of the waveform data from the memory component can be suppressed.

Because the present invention has sequenced the partial waveform data sets whose nodes are at the same time to the same positions as described above, the partial waveform data set of each waveform data set is memorized at a memory region corresponding to this position and, when the partial waveform data sets memorized at the memory regions are to be read out, the partial waveform data can be read from each memory region in one batch. Thus, even when simultaneous accesses to the memory component occur, a delay in reading of the waveform data from the memory component can be suppressed.

What is claimed is:

1. A storage medium readable by a computer, the storage medium storing a program of instructions executable by the computer to perform a function for processing waveform data, the function comprising the steps of:

(a) with a generation component, on the basis of each of a plurality of waveforms which are respectively specified by durations and amplitudes, generating a plurality of waveform data sets, each of which is structured by partial waveform data sets representing, for each of nodes which are points in the waveform at which amplitude alters, a period until a next node in time and an amplitude change condition; and (b) with a sequencing component, sequencing the partial waveform data sets of the respective nodes for each of the plurality of waveform data sets that have been generated by the generation component, wherein, in step (b), partial waveform data sets of nodes with matching times in respective waveform data sets are sequenced to matching sequence positions, and wherein, in step (b), if numbers of nodes prior to the nodes with the matching times differ between the two or more waveform data sets in which the partial waveform data sets are to be sequenced to the matching positions, then when, of the waveform data set that includes a smaller number of nodes prior to the node with the matching time, the partial waveform data set of a node prior to the node with the matching time is being sequenced, a blank position at which there is no partial waveform data is provided.

2. The storage medium of claim 1, wherein the function further comprises:

(c) with a memory component, memorizing the respective partial waveform data sets of the respective waveform data sets to memory regions of a memory medium that correspond to sequence positions of the partial waveform data sets; and (d) with a reading component, reading the partial waveform data sets of the respective waveform data sets, which have been memorized at the memory regions, in one batch for each memory region.

3. The storage medium of claim 2, wherein the function further comprises:

(e) with a waveform generation component, generating a waveform on the basis of the partial waveform data sets of each waveform data set which are read by the reading component.

4. A waveform data-processing method comprising:

(a) with a generation component, on the basis of each of a plurality of waveforms which are respectively specified by durations and amplitudes, generating a plurality of waveform data sets, each of which is structured by partial waveform data sets representing, for each of nodes which are points in the waveform at which amplitude alters, a period until a next node in time and an amplitude change condition; and (b) with a sequencing component, sequencing the partial waveform data sets of the respective nodes for each of the plurality of waveform data sets that have been generated by the generation component, wherein, in (b), partial waveform data sets of nodes with matching times in respective waveform data sets are sequenced to matching sequence positions, and wherein, in (b), if numbers of nodes prior to the nodes with the matching times differ between the two or more waveform data sets in which the partial waveform data sets are to be sequenced to the matching positions, then when, of the waveform data set that includes a smaller number of nodes prior to the node with the matching time, the partial waveform data set of a node prior to the node with the matching time is being sequenced, a blank position at which there is no partial waveform data is provided.

5. The waveform data-processing method of claim 4, further comprising:

(c) with a memory component, memorizing the respective partial waveform data sets of the respective waveform data sets to memory regions of a memory medium that correspond to sequence positions of the partial waveform data sets; and (d) with a reading component, reading the partial waveform data sets of the respective waveform data sets, which have been memorized at the memory regions, in one batch for each memory region.

6. The waveform data-processing method of claim 5, further comprising:

(e) with a waveform generation component, generating a waveform on the basis of the partial waveform data sets of each waveform data set which are read by the reading component.

7. A waveform data-processing device comprising:

a generation component which, on the basis of each of a plurality of waveforms which are respectively specified by durations and amplitudes, generates a plurality of waveform data sets, each of which is structured by partial waveform data sets representing, for each of nodes which are points in the waveform at which amplitude alters, a period until a next node in time and an amplitude change condition; and a sequencing component which sequences the partial waveform data sets of the respective nodes for each of the plurality of waveform data sets that have been generated by the generation component, wherein the sequencing component sequences partial waveform data sets of nodes with matching times in respective waveform data sets to matching sequence positions, and wherein, if numbers of nodes prior to the nodes with the matching times differ between the two or more waveform data sets in which the partial waveform data sets are to be sequenced to the matching positions, then when the sequencing component is sequencing, of the waveform data set that includes a smaller number of nodes prior to the node with the matching time, the partial waveform data set of a node prior to the node with the matching time, the sequencing component provides a blank position at which there is no partial waveform data.

8. The waveform data-processing device of claim 7, further comprising:

a memory component which memorizes the respective partial waveform data sets of the respective waveform data sets to memory regions that correspond to sequence positions of the partial waveform data sets; and a reading component which reads the partial waveform data sets of the respective waveform data sets, which have been memorized at the memory regions, in one batch for each memory region.

9. The waveform data-processing device of claim 8, further comprising:

a waveform generation component which generates a waveform on the basis of the partial waveform data sets of each waveform data set which are read by the reading component.

10. A droplet ejection device comprising:

a generation component which, on the basis of each of a plurality of waveforms which are respectively specified by durations and amplitudes, generates a plurality of waveform data sets, each of which is structured by partial waveform data sets representing, for each of nodes which are points in the waveform at which amplitude alters, a period until a next node in time and an amplitude change condition;

a sequencing component which sequences the partial waveform data sets of the respective nodes for each of the plurality of waveform data sets that have been generated by the generation component, and sequences partial waveform data sets of nodes with matching times in respective waveform data sets to matching sequence positions;

a memory component which memorizes the respective partial waveform data sets of the respective waveform data sets to memory regions that correspond to sequence positions of the partial waveform data sets;

a reading component which reads the partial waveform data sets of the respective waveform data sets, which have been memorized at the memory regions, in one batch for each memory region;

a waveform generation component which generates a waveform on the basis of the partial waveform data sets of each waveform data set which are read by the reading component; and droplet ejection components which eject droplets in accordance with the waveforms generated by the waveform generation component, wherein if numbers of nodes prior to the nodes with the matching times differ between the two or more waveform data sets in which the partial waveform data sets are to be sequenced to the matching positions, then when the sequencing component is sequencing, of the waveform data set that includes a smaller number of nodes prior to the node with the matching time, the partial waveform data set of a node prior to the node with the matching time, the sequencing component provides a blank position at which there is no partial waveform data.

* * * * *